US006904779B1

(12) United States Patent
Hickok

(10) Patent No.: US 6,904,779 B1
(45) Date of Patent: Jun. 14, 2005

(54) METHOD OF MANUFACTURING A HEAT EXCHANGER TUBE WITH PARALLEL FINS

(76) Inventor: Thomas E. Hickok, 3429 E. 58th Pl., Tulsa, OK (US) 74135

( * ) Notice: Subject to any disclaimer, the term of this patent is extended or adjusted under 35 U.S.C. 154(b) by 49 days.

(21) Appl. No.: 10/435,433

(22) Filed: May 9, 2003

(51) Int. Cl.[7] ..... B21B 19/12
(52) U.S. Cl. ..... 72/98; 72/100; 72/370.16
(58) Field of Search ..... 72/95, 98, 100, 72/104, 110, 108, 370.16

(56) References Cited

U.S. PATENT DOCUMENTS 4,299,106 A * 11/1981 Hague ..... 72/78
4,612,791 A 9/1986 Przybyla et al. ..... 72/98
4,901,553 A * 2/1990 Kuroda et al. ..... 72/97
5,003,690 A * 4/1991 Anderson ..... 29/727
5,146,979 A 9/1992 Zohler ..... 165/133
5,222,299 A 6/1993 Zohler ..... 29/890.048
5,803,164 A * 9/1998 Schuez et al. ..... 165/184
5,916,318 A * 6/1999 Anderson ..... 72/98

* cited by examiner

*Primary Examiner*—Ed Tolan
(74) *Attorney, Agent, or Firm*—Paul H. Johnson; Gable & Gotwals

(57) ABSTRACT

A method of forming a finned tube in which the fins are planar, paralleled and extend radially to the tube longitudinal axis, including the steps of positioning at least one rotating forming roll against the tube exterior surface, the forming roll being spaced from the tube and rotatable about an axis that is parallel to said tube longitudinal axis, the forming roll having on the surface thereof an elongated helically arranged fin forming protrusion, the helical protrusion having a pitch of "x" and linearly advancing the tube past the forming tool a distance of "x" for each revolution of the forming roll.

5 Claims, 6 Drawing Sheets

METHOD OF MANUFACTURING A HEAT EXCHANGER TUBE WITH PARALLEL FINS

REFERENCE TO PENDING APPLICATIONS

This application is not related to any pending domestic or international patent applications.

REFERENCE TO MICROFICHE APPENDIX

This application is not referenced in any microfiche appendix.

FIELD OF THE INVENTION

The invention relates to a method and the machine for carrying out the method for forming parallel fins on the surface of an elongated tubular member.

BACKGROUND OF THE INVENTION

The basic method for providing fins on a tube is by a forming roll rotating against the surface of the tube. A tubular work piece on the tube external surfaces is caused to flow by plastic deformation to form upstanding spiral fins. Machines for accomplishing this method are well-known in the industry and commonly commercially available—that is, each finned tube has a continuous spiral fin formed on its exterior surface. Tubes having spirally formed fins are commonly used in the construction of heat exchangers.

A prior issued patent that illustrates methods of forming spiral fins on a tube is U.S. Pat. No.5,003,690 issued on Apr. 2,1991 entitled FINNING AND THREAD ROLLING MACHINE. Other patents showing the construction of spirally wound fins on tubular members include the following:

| PATENT NUMBER | INVENTOR(S) | TITLE |
|---|---|---|
| 4,612,791 | Przbyla, et al. | Method and Apparatus for Rolling Transversely Ribbed Bimetallic Pipes |
| 5,146,979 | Zohler | Enhanced Heat Transfer Surface and Apparatus and Method of Manufacture |
| 5,222,299 | Zohler | Enhanced Heat Transfer Surface and Apparatus and Method of Manufacture |
| 5,803,164 | Schuez, et al. | Multiple Finned Tube and a Method for its Manufacture |
| 5,916,318 | Anderson | Machine for Simultaneously Forming Threads or Fins on Multiple Cylindrical Work pieces |

By and large each of these references teach a method and/or machine for producing an integral fin tube in which the fin is spiraled. Typically, a spiraled fin is formed on an elongated tubular member by rotating the tubular member against one or more forming rolls that are supported by arbors capably of being adjustably positioned inwardly and outwardly radially from the work piece. Rotary motion is applied to one or more forming rolls to cause the work piece to also rotate as fins are formed by metal displacement on the exterior of the work piece.

In each case, the formed fin is an elongated spiral. The invention herein is, in contrast with these prior art references, concerned not with the production of a spiral fin, but with the production of radial fins. By "radial fins" it is meant a sequence of closely spaced, paralleled fins where each fin is a complete, uninterrupted circular portion extending in a radial plane of the axis of a tubular member.

Air flowing through a heat exchanger having tubes with parallel fins undergoes reduced pressure drop compared to a heat exchanger of the same size and capacity wherein the fins are spiraled.

BRIEF SUMMARY OF THE INVENTION

The present invention is a method and machine for forming planer, paralleled and spaced apart fins on the exterior of a tube. A machine for practicing the method includes a plurality of at least three arbor blocks arranged in a common plane around the work piece and spaced an equal distance from the work piece axis of rotation. A forming roll is supported by each of the arbor blocks. Each forming roll has a surface with an elongated helically arranged fin forming protrusion that bears against the exterior surface of the tubular work piece. Each forming roll is rotatable about an axis that is parallel to the work piece axis of rotation.

Rotary energy is coupled to the forming rolls so that the rolls are rotated simultaneously. Further, the forming rolls are rotationally in interlocked relationship with respect to each other. When three forming rolls are used, each forming roll is rotationally displaced 120° from each of the adjacent forming rolls. The forming rolls cause the tubular work piece to rotate.

The work piece advances axially due to the helically or spirally wound fin forming protrusion on each of the forming rolls.

In a preferred arrangement, the protrusions formed on each of the forming rolls is arranged to have an outer work piece engaging a peripheral edge that increases in diameter from one end towards the opposite end of forming roll. Stated another way, the fin forming protrusion of each of forming roll progresses in depth with respect to the forming roll rotational axis.

A better understanding of the invention will be obtained from the following description of the preferred embodiment of the invention taken in conjunction with the attached drawings.

DETAILED DESCRIPTION OF THE PREFERRED EMBODIMENTS

Figure 1:
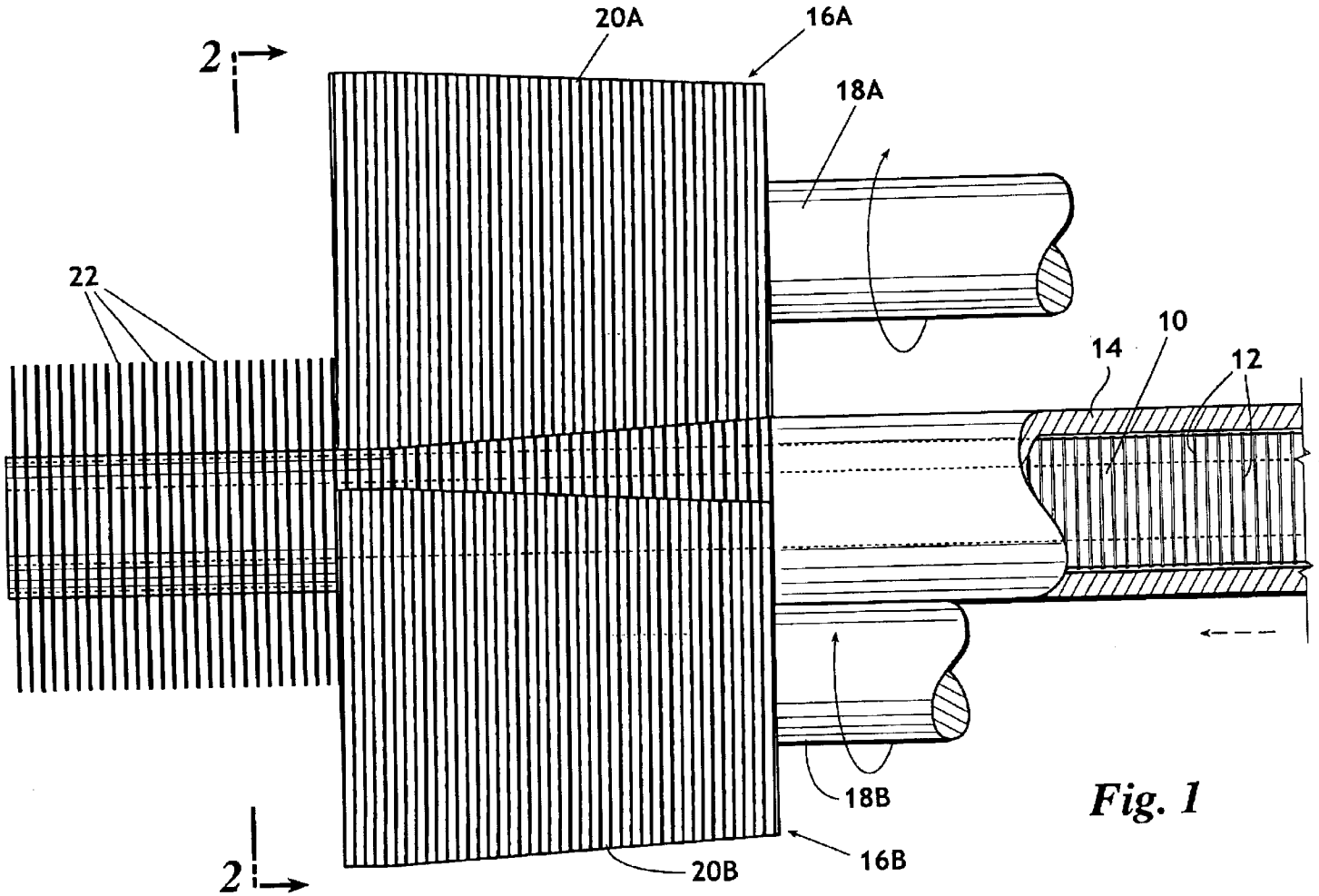
FIG. 1 is a fragmentary elevational view illustrating a system for forming parallel fins on the external surface of a tubular member. In the arrangement of FIG. 1 the tubular member has a concentric outer shell, referred to as a "muff," that is cold flowed by forming rolls to form radially extending parallel circumferential fins.

FIG. 1 is a fragmentary external view showing diagrammatically the principles of the invention. In this figure, a base tube 10 that may typically be made of a heat conductive metal such as steel has formed on the exterior surface thereof low height integral fins 12. These low height fins 12 cause an external concentric tubular muff 14 securely adhered to the base tube. Muff 14 is formed of a material that is easily cold flowable—that is, of a material that can be deformed relatively easily at ambient temperatures. Aluminum or alloys of aluminum are ideal metals for this purpose. The muff 14 has an internal diameter closely fitting the external diameter of base tube 10.

The objective of the system of this invention is to cold flow the muff 14 to form paralleled radial fins for purposes of heat exchange. In order to form muff 14 into such radial fins a plurality of forming rolls is employed. In FIG. 1 two such forming rolls seen, each generally indicated by the numeral 16, that is, specifically a first forming roll 16A and a second forming roll 16B. Forming roll 16A is supported by a shaft 18A and in like manner forming roll 16B is rotatably supported by shaft 18B.

Each of forming rolls 16A and 16B is provided with spirally formed helical grooves, the helical grooves on forming roll 16A being indicated by the numeral 20A and those on forming roll 16B by the numeral 20B. The helical grooves contact and deform the deformable muff 14 to generate radial fins 22. Each of the fins 22 is radial—that is, each fin is in a plane perpendicular to the longitudinal axis of base tube 10 and correspondingly, the longitudinal axis of the muff 14. Fins 22 are coplanar with each other and, that is parallel to each other; as contrasted with the typical heat exchanger finned tube in which fins are helically arranged. Further, fins 22 are not helical—that is, the fins are not continuations of adjacent fins but instead they extend individually and radially from the muff of which they are formed and therefore extend individually and radially in parallel planes from base tube 10.

Figure 2:
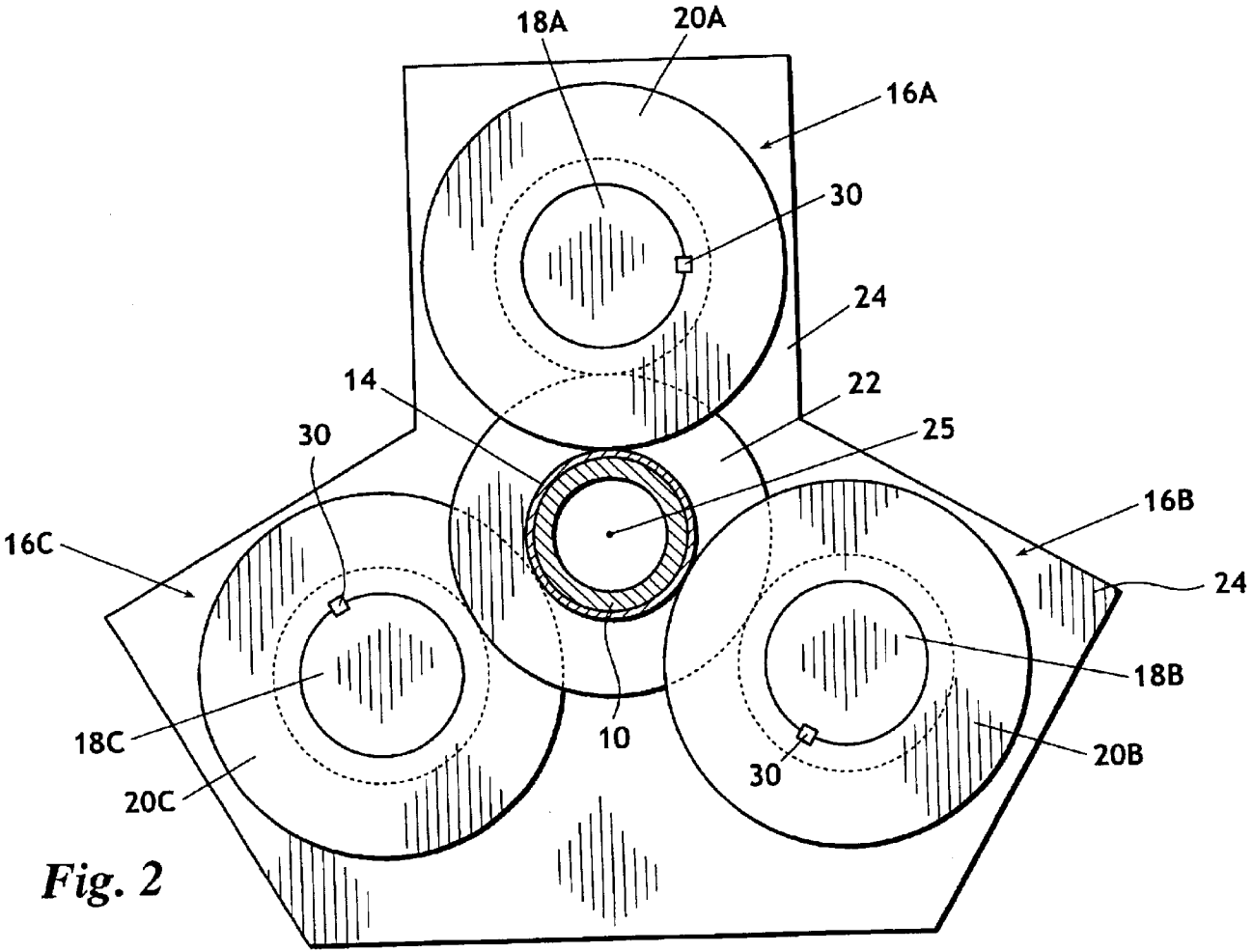
FIG. 2 is an external cross-sectional view taken along the line 2—2 of FIG. 1 showing the use of three forming rolls for forming spaced apart parallel radial fins in an alloy muff positioned on the exterior of a base tube. In the arrangement of FIG. 2, three forming rolls equally spaced about the base tube are employed.
Figure 3:
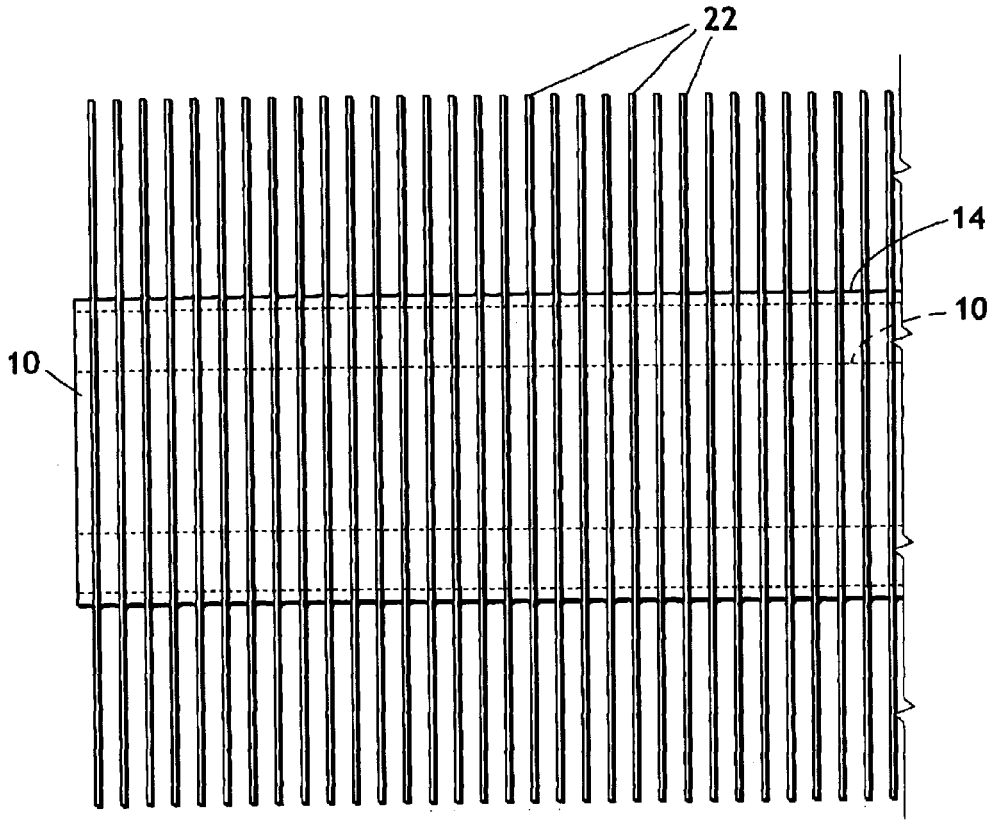
FIG. 3 is an elevational view of a portion of a completed fin tube having parallel radial fins.

FIG. 2 is an elevational view as taken along the line 2—2 of FIG. 1. This view shows a bearing block 24 that supports shaft 18A and 18B. In this arrangement, three such shafts are employed there being a third shaft 18C that is not seen in FIG. 1 since it is directly behind second shaft 18B. The three shafts 18A, 18B and 18C are supported at equal distances about the longitudinal axis 25 of base tube 10 and are radially spaced 120° apart. Shaft 18C supports a forming roll generally indicated by the numeral 16C that has thereon helical groove 20C. The three forming rolls, 16A, 16B and 16C, are, as previously indicated, spaced equal angular distances about the radius 25 of base pipe 10 and therefore the forming roll firmly secure the base pipe 10 and tubular muff 14 so that the rotation of the forming rolls causes the base tube and muff to concurrently rotate.

Figure 5:
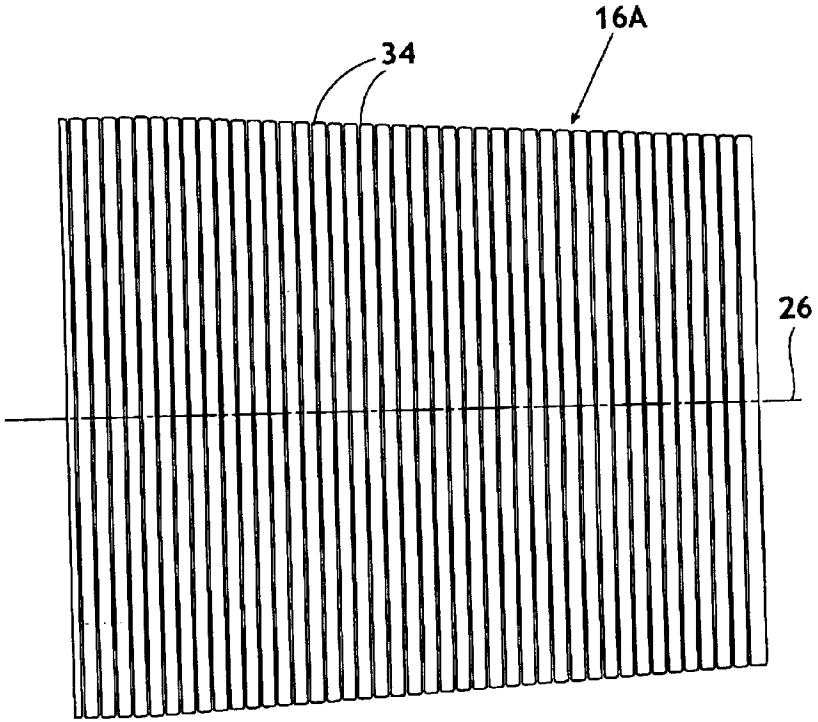
FIG. 5 is an elevational external view of a forming roll.

FIG. 5 is an external view of formal roll 16A. Note that the outer circumferential periphery of the forming roll 16A is tapered relative to the forming roll longitudinal axis 26.

Figure 4:
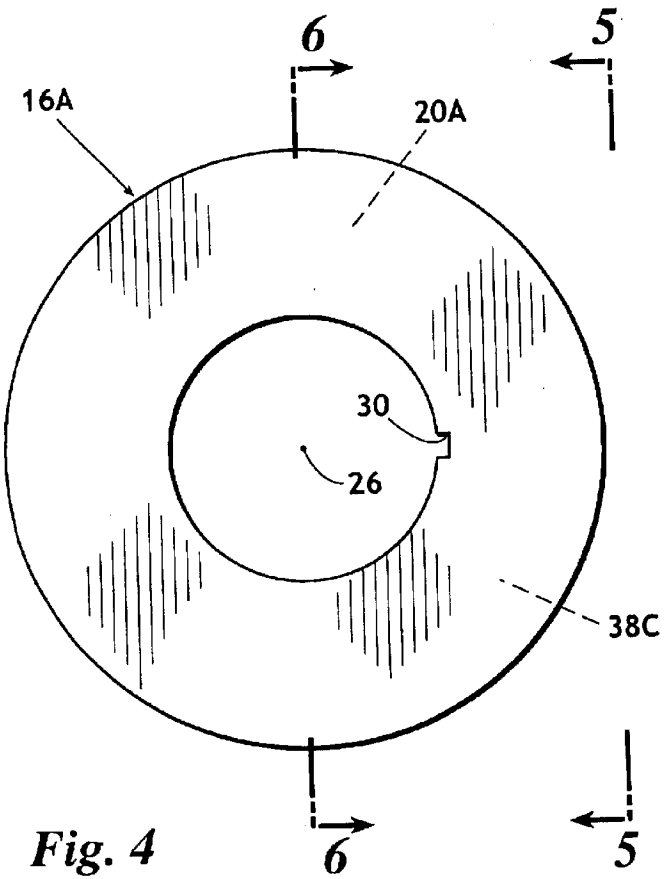
FIG. 4 is an end view of a forming roll.
Figure 6:
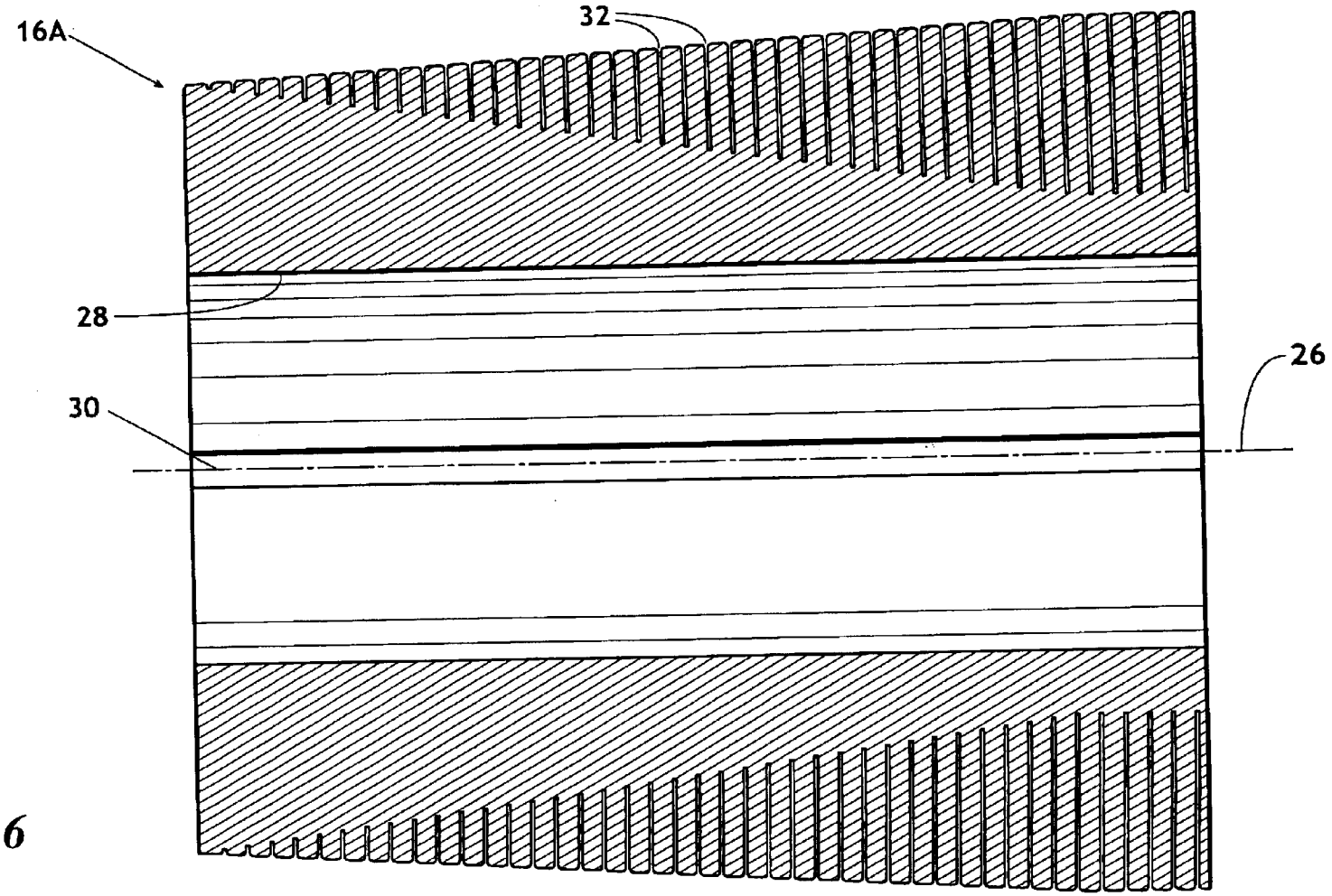
FIG. 6 is an enlarged cross-sectional view of the forming roll as taken along the line 6—6 of FIG. 4.

FIG. 6 is an enlarged cross-sectional view of the forming roll of FIGS. 4 and 5. The forming roll 16A has a cylindrical opening 28 therethrough that receives shaft 18A, the shaft not being shown in FIG. 4, 5 or 6. The cylindrical opening 28 is provided with a longitudinal keyway 30 by which it is keyed to shaft 18A that supports it when in use. Keyway 30 is indicative of the fact that the system of the invention requires the forming rolls to be rotationally interlocked with respect to each other. Each of the forming rolls 16A, 16B and 16C are manufactured to be identical. The forming rolls must be rotationally interlocked to each other since each groove in each forming roll must receive a radial fin being formed on the muff tube as the muff tube linearly advances during the manufacturing process. For this purpose, each of the forming rolls 16A, 16B and 16C have, as illustrated in FIG. 6, grooves 32 therein that are spirally formed as a part of the forming rolls. These grooves 32 receive the cold flow of metal from the muff tube so that the fins 22 as seen in FIG. 1, are cold flowed into the grooves 32. Therefore, it is imperative that the position of each of the three forming rolls, 16A, 16B and 16C be precisely aligned relative to each other not only in their longitudinal position but also in their radial relationship. Therefore, the rotational axis of each of the forming rolls 16A, 16B and 16C is longitudinally positioned exactly parallel to each other and to the longitudinal axis of the base tube. Further, the forming rolls are rotationally positioned 120° apart FIG. 2 shows a keyway 30 in forming roll 16A. Keyway 30 is in like manner provided in forming roll 16B and 16C and the keyways are rotationally positioned 1200° apart as illustrated.

As previously stated, the helical groove 32 in each of the forming rolls 16A, 16B and 16C is spirally formed.

Figure 7:
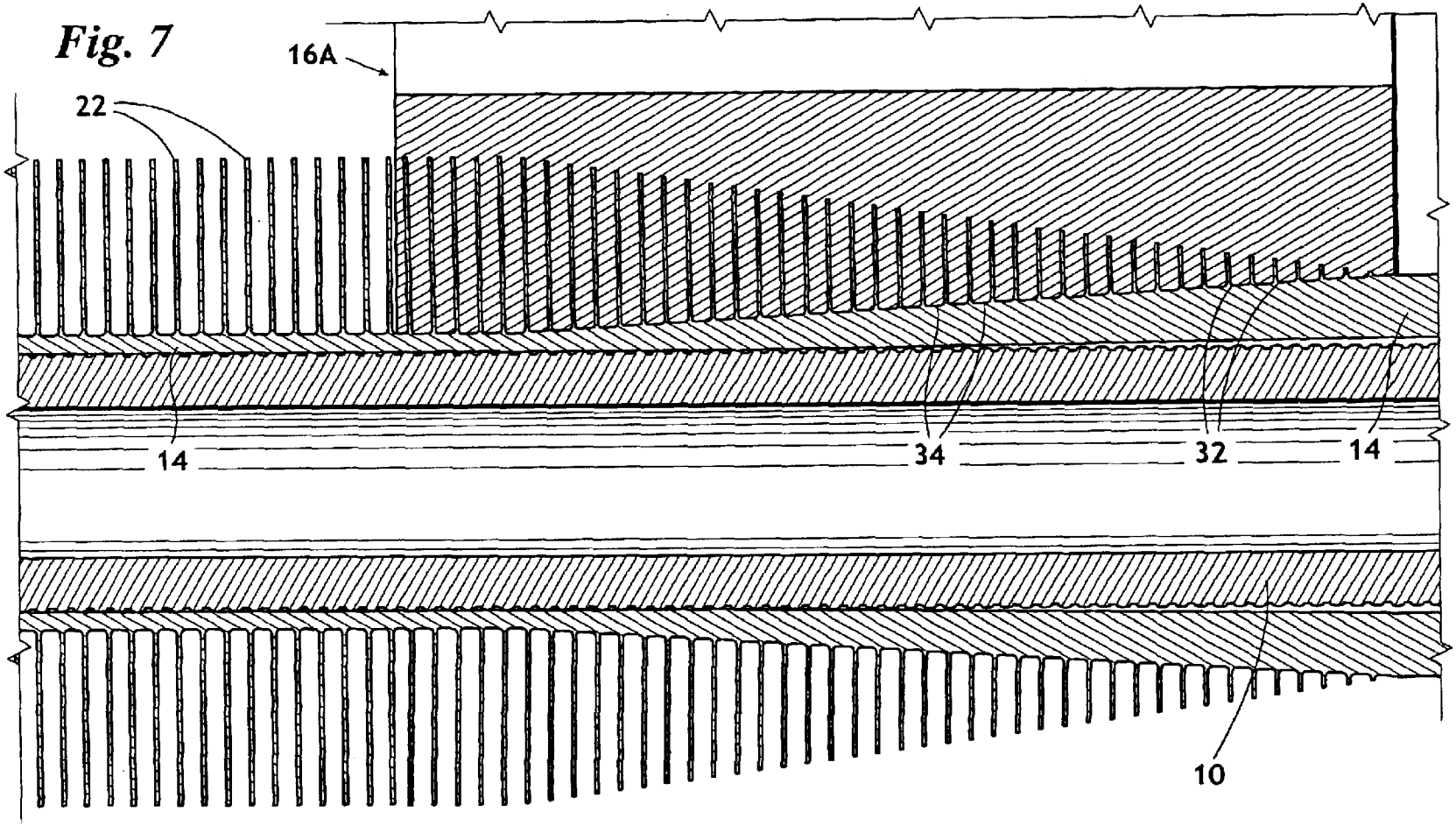
FIG. 7 is an enlarged view of a portion of the length of a base tube having a flow deformable tubular muff thereon and showing a portion of a forming roll that is used for cold flowing the muff into radial, paralleled fins.

FIG. 7 shows a fragmentary portion of forming roll 16A and shows the grooves 32 of increasing depth in the external surface 34. As the forming roll presses against the deformable muff portion 14, the metal of the muff portion cold flows into grooves 32 to form the radial fins 22. In this process the resulting base thickness of the deformable tubular muff 14 is reduced from the full thickness of the right side of FIG. 7 to a substantially reduced thickness at the left side, the metal resulting from the reduction in thickness forming fins 22.

The invention herein employs forming rolls to cold flow the external surface of a tube or, as illustrated in this case, a deformable tubular muff affixed to the external surface of a base tube to generate fins. The difference in this invention is that the grooves in the forming rolls are helically arranged and the plurality of forming rolls are rotationally interlocked so that the fins formed on the tubular muff passing between the spaced apart forming rolls are in radial planes compared to the formation of a continuous helical wound fin as has been customary with previously produced fin tube machines.

An illustration of a machine that could be used for practicing this invention is shown in U.S. Pat. No. 5,003,690 entitled FINNING AND THREAD ROLLING MACHINE that issued on Apr. 2, 1991. This machine can be employed to practice this invention with the significant difference being that the forming rolls are rotationally interlocked with respect to each other to ensure that the fins formed are in radial planes and are not the result of a continuous spirally wound fin as in this patent.

Figure 8:
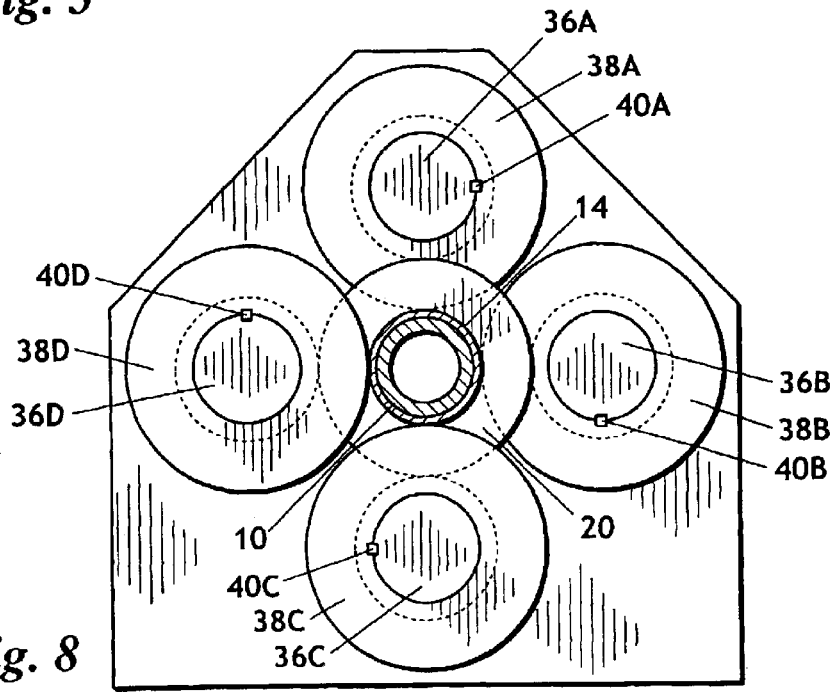
FIG. 8 shows the arrangement such as in FIG. 2 but showing the use of four spaced apart forming rolls.

FIG. 8 shows the principals of this invention wherein four shafts are employed—that is, shafts 36A through 36D that are equally spaced about base tube 10 and tubular muff 14. Forming rolls 38A through 38D are rotationally interlocked to each other 90° apart as shown by the placement of keys 40A through 40D. The base tube and muff axially advance, so that resulting fins 20 will be in parallel spaced apart planes and will not be an elongated helical spiral as with previous fin tube manufacturing machines.

It is understood that the invention is not limited in its application to the details of construction and arrangement of components illustrated in the accompanying drawings. The invention is capable of other embodiments and of being practiced or carried out in a variety of ways. Phraseology and terminology employed herein are for the purpose of description and not limitation.

While the invention has been described with a certain degree of particularity, it is manifest that many changes may be made in the details of construction and the arrangement of components without departing from the spirit and scope of this disclosure. The invention is not limited to the embodiments set forth herein for purposes of exemplification, but is to be limited only by the scope of the attached claims, including the full range of equivalency to which each element thereof is entitled.

What is claimed is:

1. A machine for forming non-helical fins on the exterior of a tube having a workpiece axis of rotation, comprising:

(a) a plurality of at least three arbor blocks arranged in a common plane around the workpiece and spaced equal distances from the axis of rotation;

(b) a forming roll having a surface with an elongated helically arranged fin forming protrusion of a pitch of "x" rotatably supported by each said arbor block, the forming rolls being rotatable in rotational interlocked relationship, each about an axis that is parallel to the workpiece axis of rotation;

(c) a rotary energy source coupled for simultaneously rotating said forming rolls; and (d) means to linearly advance the tube a distance "x" with each rotation of said forming rolls whereby a series of separate, spaced apart, radially extending, paralleled fins are formed on the tube.

2. A machine for forming planar fins on the exterior of a tube according to claim 1 wherein said tube has a concentric tubular muff thereon and wherein the parallel and spaced apart fins are formed in said tubular muff.

3. A machine for forming planar fins on the exterior surface of a tube according to claim 1 wherein each said forming roll has a spirally formed fin forming protrusion that progresses in depth with respect the forming roll rotational axis.

4. A method of forming a non-helical finned tube in which the fins are separate, planar, paralleled and extend radially of the tube longitudinal axis, comprising the steps of:

supporting a tube for simultaneous rotation about its longitudinal axis and for linear advancement;

positioning at least one rotating forming roll against the tube exterior surface, the forming roll being rotatable about an axis that is parallel to and spaced from said tube longitudinal axis, the forming roll having on the surface thereof an elongated helically arranged fin forming protrusion, the helical protrusion having a pitch of "x";

rotating said forming roll and said tube simultaneously at the same rotational rate; and linearly advancing the tube past said forming roll a distance of "x" for each revolution of said forming roll and tube.

5. A method according to claim 4, wherein the height of said helically placed protrusion increase in the direction from one end to another of said forming roll.

* * * * *